US010487833B2

(12) United States Patent
Shoulders

(10) Patent No.: US 10,487,833 B2
(45) Date of Patent: Nov. 26, 2019

(54) METHOD OF IMPROVING COMPRESSOR BEARING RELIABILITY

(71) Applicant: Carrier Corporation, Farmington, CT (US)

(72) Inventor: Stephen L. Shoulders, Baldwinsville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/104,681

(22) PCT Filed: Oct. 16, 2014

(86) PCT No.: PCT/US2014/060803
§ 371 (c)(1),
(2) Date: Jun. 15, 2016

(87) PCT Pub. No.: WO2015/094465
PCT Pub. Date: Jun. 25, 2015

(65) Prior Publication Data

US 2016/0312782 A1 Oct. 27, 2016

Related U.S. Application Data

(60) Provisional application No. 61/917,624, filed on Dec. 18, 2013.

(51) Int. Cl.
*F01C 1/16* (2006.01)
*F03C 2/00* (2006.01)
(Continued)

(52) U.S. Cl.
CPC ..... *F04C 29/028* (2013.01); *F04B 39/02* (2013.01); *F04B 39/0284* (2013.01);
(Continued)

(58) Field of Classification Search
CPC ..... F04C 18/16; F04C 23/008; F04C 29/02; F04C 29/028; F04C 2240/30;
(Continued)

(56) References Cited

U.S. PATENT DOCUMENTS 767,705 A 8/1904 Lyman
3,811,805 A 5/1974 Moody, Jr. et al.
(Continued)

FOREIGN PATENT DOCUMENTS

CN 1289895 A 4/2001
CN 1336986 A 2/2002
(Continued)

OTHER PUBLICATIONS

Chinese Office Action and Search Report with English Translation; Application No. 201480069113.5, dated Jun. 8, 2017, pp. 1-22.
(Continued)

*Primary Examiner* — Theresa Trieu
(74) *Attorney, Agent, or Firm* — Cantor Colburn LLP

(57) ABSTRACT

A compressor assembly includes a housing assembly and a first rotor and second rotor arranged within the housing assembly. The first rotor is supported for rotation by a first inlet bearing adjacent an inlet end of the housing assembly and by a first discharge bearing adjacent a discharge end of the housing assembly. The second rotor is supported for rotation by a second inlet bearing adjacent the inlet end of the housing assembly and by a second discharge bearing adjacent the discharge end of the housing assembly. A first lubricant flow path supplies lubricant to at least two of the first discharge bearing, the first inlet bearing, the second discharge bearing, and the second inlet bearing sequentially.

8 Claims, 6 Drawing Sheets

(51) Int. Cl.

| | |
|---|---|
| ***F03C 4/00*** | (2006.01) |
| ***F04C 29/02*** | (2006.01) |
| ***F04B 39/02*** | (2006.01) |
| ***F04C 18/16*** | (2006.01) |
| *F04C 23/00* | (2006.01) |

(52) U.S. Cl.
CPC ..... *F04C 18/16* (2013.01); *F04C 29/02* (2013.01); *F04C 23/008* (2013.01); *F04C 2240/30* (2013.01); *F04C 2240/50* (2013.01); *F04C 2240/52* (2013.01)

(58) Field of Classification Search
CPC .. F04C 2240/50; F04C 2240/52; F04B 39/02; F04B 39/0284
USPC ..... 418/83–85, 97–99, 102, 201.1
See application file for complete search history.

(56) References Cited

U.S. PATENT DOCUMENTS

| | | | | |
|---|---|---|---|---|
| 3,911,114 | A | 11/1975 | Hamilton et al. | |
| 3,922,114 | A | 11/1975 | Hamilton et al. | |
| 4,375,156 | A | 3/1983 | Shaw | |
| 4,878,820 | A | 11/1989 | Doi et al. | |
| 5,469,713 | A | 11/1995 | Wardle et al. | |
| 5,832,737 | A * | 11/1998 | Moilanen | F04C 28/125 418/201.2 |
| 6,182,467 | B1 | 2/2001 | Zhong et al. | |
| 6,196,814 | B1 | 3/2001 | Cooksey et al. | |
| 6,422,844 | B2 | 7/2002 | Hioki et al. | |
| 6,431,843 | B1 | 8/2002 | Dudley | |
| 6,443,711 | B1 | 9/2002 | Miller, Jr. | |
| 6,612,820 | B1 * | 9/2003 | Staat | F04C 29/02 418/97 |
| 6,672,101 | B2 | 1/2004 | Gennami et al. | |
| 6,752,605 | B2 | 6/2004 | Dreiman et al. | |
| 6,969,242 | B2 | 11/2005 | Yannascoli et al. | |
| 7,347,301 | B2 | 3/2008 | Sekiya et al. | |
| 7,614,862 | B2 | 11/2009 | Van Der Heggen et al. | |
| 7,677,051 | B2 | 3/2010 | Von Borstel | |
| 7,690,482 | B2 | 4/2010 | Shoulders | |
| 7,713,040 | B2 | 5/2010 | Kimura et al. | |
| 8,006,514 | B2 | 8/2011 | Tsuboi | |
| 8,104,298 | B2 | 1/2012 | Sishtla | |
| 8,215,114 | B2 | 7/2012 | Smith et al. | |
| 8,435,020 | B2 * | 5/2013 | Amano | F04C 29/02 418/98 |
| 8,512,019 | B2 * | 8/2013 | Kakiuchi | F04C 29/02 418/98 |
| 2011/0256008 | A1 | 10/2011 | Hattori et al. | |

FOREIGN PATENT DOCUMENTS

| | | | | |
|---|---|---|---|---|
| CN | 101600884 | A | 12/2009 | |
| CN | 203067286 | U | 7/2013 | |
| EP | 0758054 | A1 | 2/1997 | |
| EP | 1087190 | A1 | 3/2001 | |
| EP | 1236902 | A2 | 9/2002 | |
| EP | 2423508 | A2 | 2/2012 | |
| GB | 2477777 | B * | 5/2012 | F01C 1/16 |
| JP | S569694 | A | 1/1981 | |
| JP | H10009179 | | 1/1998 | |
| WO | 0042322 | A1 | 7/2000 | |
| WO | 2007128309 | A1 | 11/2007 | |
| WO | 2013126970 | A1 | 9/2013 | |

OTHER PUBLICATIONS

Notification of Transmittal of the International Search Report and the Written Opinion of the International Searching Authority, or the Declaration for International Application No. PCT/US2014/060803 dated Feb. 9, 2015; dated Feb. 18, 2015; 12 pages.

Chinese Office Action with English Translation; Application No. 201480069113.5, dated Nov. 3, 2017, pp. 1-10.

PCT International Preliminary Report on Patentability; International Application No. PCT/US2014/060803; International Filing Date: Oct. 16, 2014; dated Jun. 21, 2016, pp. 1-8.

CN Office Action with English Translation; CN Application No. 201480069113.5; dated Jan. 26, 2018; 18 pp.

Fourth Office Action for Patent Application No. 201480069113.5 issued by the State Intellectual Property Office, P.R. China dated Jul. 31, 2018 (17 pp.).

* cited by examiner

METHOD OF IMPROVING COMPRESSOR BEARING RELIABILITY

BACKGROUND OF THE INVENTION

The invention relates generally to compressor systems and, more particularly, to lubrication of one or more bearings in a compressor of a refrigeration system. Substitute Refrigerant systems are utilized in many applications to condition an environment. The cooling or heating load of the environment may vary with ambient conditions, occupancy level, other changes in sensible and latent load demands, and as the temperature and/or humidity set points are adjusted by an occupant of the environment.

Use of a variable speed drive for the compressor motor improves the efficiency of refrigerant systems. Often, the compressor need not be operated at full speed, such as when the cooling load on the refrigerant system is relatively low. Under such circumstances, it might be desirable to reduce the compressor speed, and thus reduce the overall energy consumption of the refrigerant system. Implementation of a variable speed drive is one of the most efficient techniques to enhance system performance and to reduce life-cycle cost of the equipment over a wide spectrum of operating environments and potential applications, especially at part-load conditions.

However, compelling reliability concerns limit the allowable compressor speed reduction. In particular, inadequate lubrication of the compressor elements such as bearings may present a problem at low operating speeds. Speed dependent reliability concerns arise because damaging contact may occur between two surfaces in close proximity depending on their relative speed and the viscosity of the lubricant between them. As the speed is reduced, the viscosity of the lubricant must be increased to maintain a separating film between the two surfaces. The viscosity required to maintain separation of the two surfaces at a given operating speed depends in part on geometric features of the surfaces, so different types of bearings may have different requirements to prevent damage from occurring. Commonly, bearings have a smaller diameter have a higher viscosity requirement at any speed, but geometric features may override such diameter effects.

Most oils used in refrigerant screw compressors form a solution of mixed refrigerant and oil. When mixed, the refrigerant dilutes the oil, lowering the viscosity of the resultant refrigerant-oil mixture compared to the viscosity of pure oil. The amount of refrigerant dissolved in oil in a stable solution is a chemically determined function of pressure and temperature. During non-equilibrium transients, such as may occur during pressure drop just downstream of an orifice, or due to heat addition, or due to mechanical action that induces cavitation, refrigerant can out-gas from the solution as a new equilibrium state develops. Such occurrences of out-gassing generally increase viscosity because they result in less dilution of oil.

Bearing operation introduces viscous losses that result in heating of the lubricant. Heat transfer from hot portions of a compressor housing may also raise lubricant temperature. The resulting increase in lubricant temperature my cause out-gassing of some refrigerant. In addition, mechanical agitation of the lubricant as it passes through bearings can also cause cavitation which results in refrigerant out-gassing. As a result of out-gassing, lubricant flow exiting bearings usually has higher viscosity than when it entered bearings because the fraction of refrigerant in solution has been reduced.

Due to the minimum speed limitation that must be imposed to ensure reliability, some of the energy efficiency that could be potentially provided by the variable speed drive is essentially eliminated. Thus, there is a need to provide a compressor that can reliably operate at a lower speed than what can be achieved with current designs.

BRIEF DESCRIPTION OF THE INVENTION

According to an aspect of the invention, a compressor assembly is provided including a housing assembly. A first rotor and a second rotor are arranged within the housing assembly. The first rotor is supported for rotation by a first inlet bearing adjacent an inlet end of the housing assembly and by a first discharge bearing adjacent a discharge end of the housing assembly. The second rotor is supported for rotation by a second inlet bearing adjacent the inlet end of the housing assembly and by a second discharge bearing adjacent the discharge end of the housing assembly. A first lubricant flow path is configured to supply lubricant to more than one of the first discharge bearing, the first inlet bearing, the second discharge bearing, and the second inlet bearing generally sequentially.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
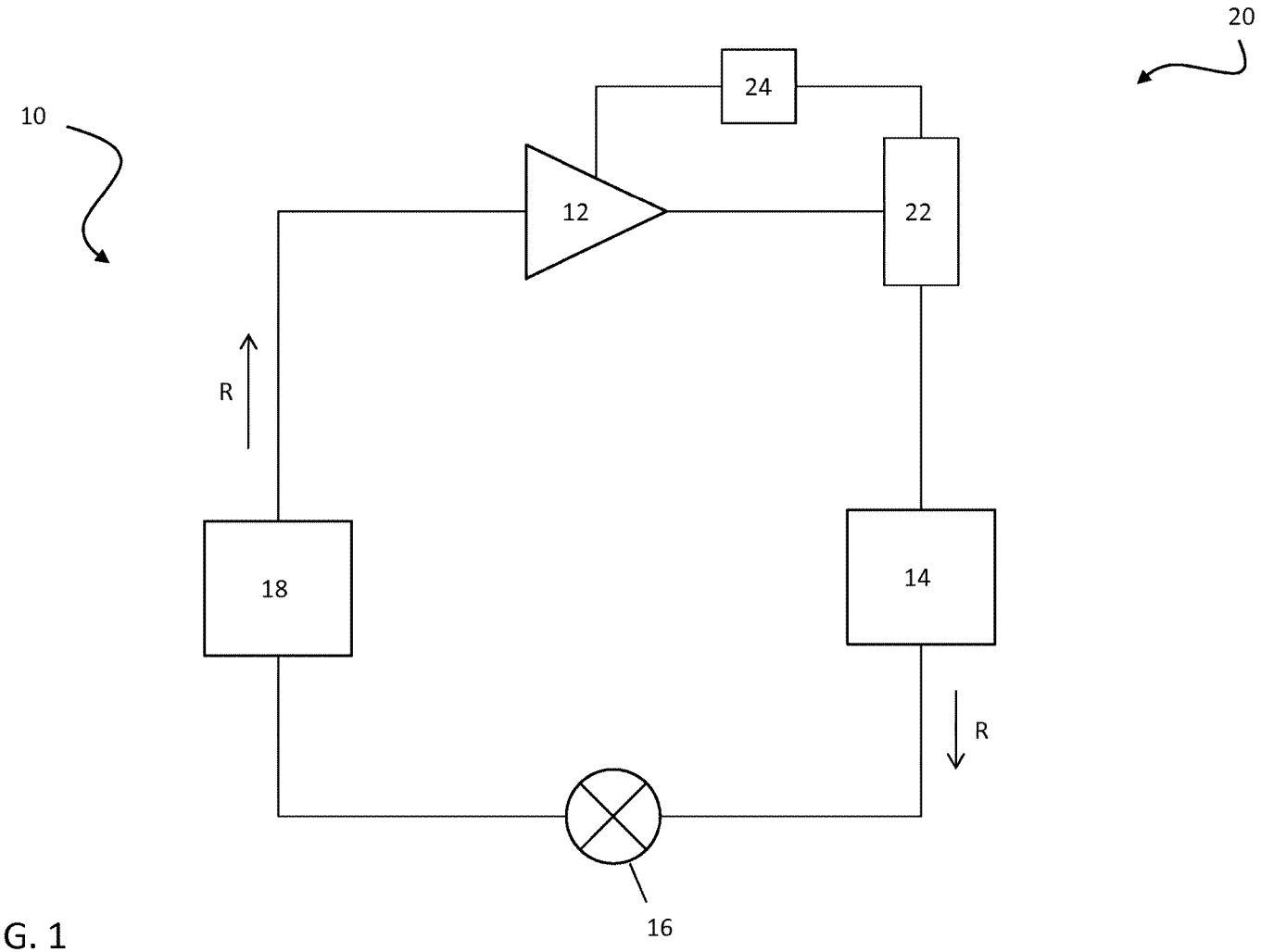
FIG. 1 is a schematic diagram of an example of a refrigeration system.

Referring now to FIG. 1, a conventional vapor compression or refrigeration cycle 10 of an air conditioning system is schematically illustrated. A refrigerant R is configured to circulate through the vapor compression cycle 10 such that the refrigerant R absorbs heat when evaporated at a low temperature and pressure and releases heat when condensed at a higher temperature and pressure. Within this cycle 10, the refrigerant R flows in a clockwise direction as indicated by the arrows. The compressor 12 receives refrigerant vapor from the evaporator 18 and compresses it to a higher temperature and pressure, with the relatively hot vapor then passing to the condenser 14 where it is cooled and condensed to a liquid state by a heat exchange relationship with a cooling medium such as air or water. The liquid refrigerant R then passes from the condenser 14 to an expansion valve 16, wherein the refrigerant R is expanded to a low temperature two phase liquid/vapor state as it passes to the evaporator 18. After the addition of heat in the evaporator, low pressure vapor then returns to the compressor 12 where the cycle is repeated.

A lubrication system, illustrated schematically at 20, may be integrated into the air conditioning system. Because lubricant may become entrained in the refrigerant as it passes through the compressor 12, an oil separator 22 is positioned directly downstream from the compressor 12. The refrigerant separated by the oil separator 22 is provided to the condenser 14, and the lubricant isolated by the oil separator 22 is provided to a lubricant reservoir 24 configured to store a supply of lubricant. Lubricant from the reservoir 24 is then supplied to some of the moving portions of the compressor 12, such as to the rotating bearings for example, where the lubricant becomes entrained in the refrigerant and the cycle is repeated.

Figure 2:
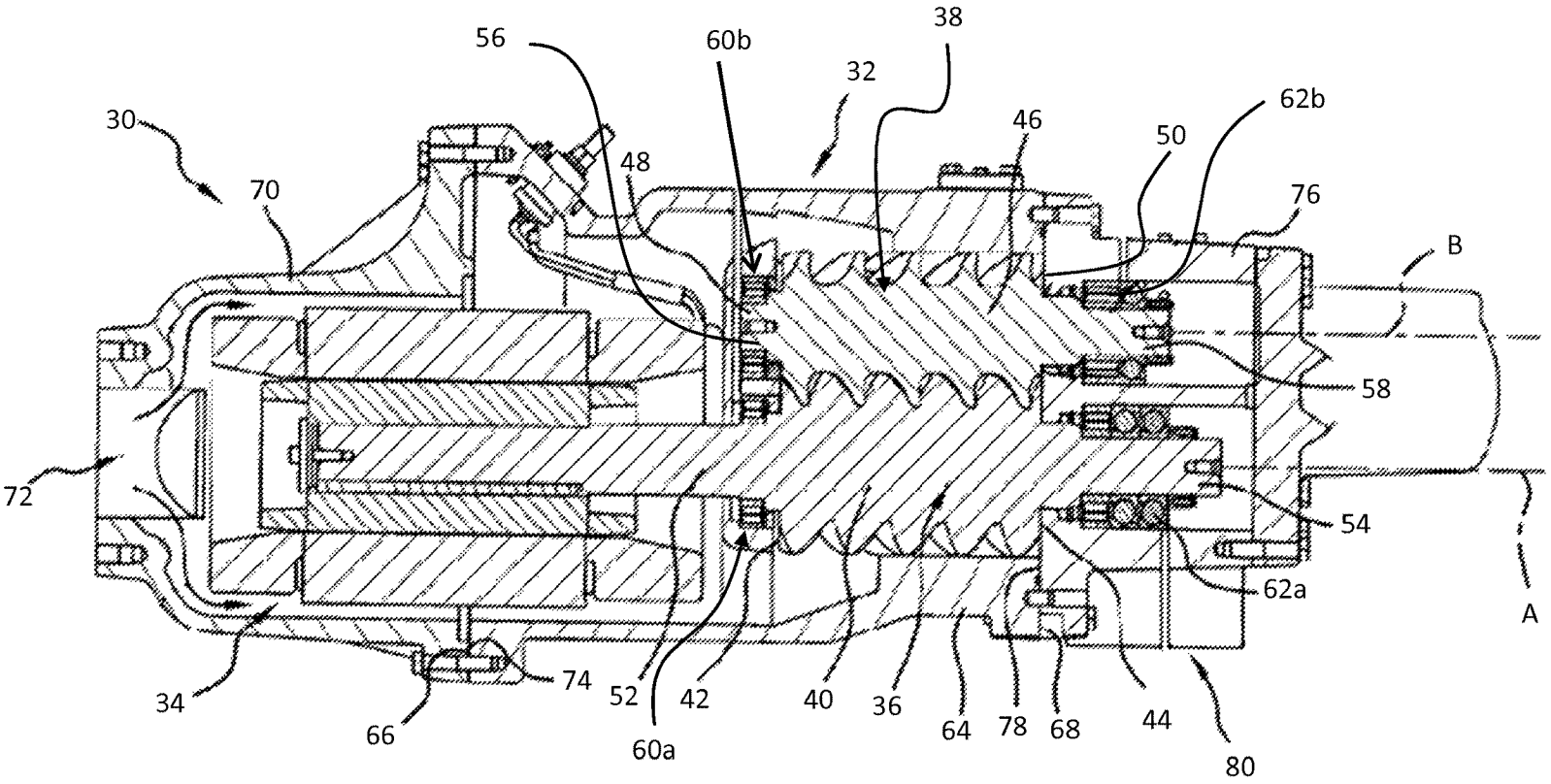
FIG. 2 is a simplified cross-sectional view of a screw compressor of a refrigeration system.

Referring now to FIG. 2, an example of a screw compressor 12, commonly used in air conditioning systems, is illustrated in more detail. The screw compressor 12 includes a housing assembly 32 containing a motor 34 and two or more intermeshing screw rotors 36, 38 having respective central longitudinal axes A and B. In the exemplary embodiment, rotor 36 has a male lobed body 40 extending between a first end 42 and a second end 44. The male lobed body 40 is enmeshed with a female lobed body 46 of the other rotor 38. The female lobed body 46 of rotor 38 has a first end 48 and a second end 50. Each rotor 36, 38 includes shaft portions 52, 54, 56, 58 extending from the first and second ends 42, 44, 48, 50 of the associated lobed bodies 40, 46. Shaft portions 52 and 56 are mounted to the housing 32 by one or more inlet bearings 60*a* and 60*b*, respectively and shaft portions 54 and 58 are mounted to the housing 32 by one or more outlet bearings 62*a*, 62*b* respectively for rotation about the associated rotor axis A, B.

In the exemplary embodiment, the motor 34 and a shaft portion 52 of rotor 36 may be coupled so that the motor 34 drives that rotor 36 about its axis A. When so driven in an operative first direction, the rotor 36 drives the other rotor 38 in an opposite second direction. The exemplary housing assembly 32 includes a rotor housing 64 having an upstream/inlet end face 66 and a downstream/discharge end face 68 essentially coplanar with the rotor second ends 44 and 50. Although a particular compressor type and configuration is illustrated and described herein, other compressors, such as having three rotors for example, are within the scope of the invention.

The exemplary housing assembly 32 further comprises a motor/inlet housing 70 having a compressor inlet/suction port 72 at an upstream end and having a downstream face 74 mounted to the rotor housing upstream face 66 (e.g., by bolts through both housing pieces). The assembly 32 further includes an outlet/discharge housing 76 having an upstream face 78 mounted to the rotor housing downstream face 68 and having an outlet/discharge port 80. The exemplary rotor housing 64, motor/inlet housing 70, and outlet housing 76 may each be formed as castings subject to further finish machining.

Figure 3:
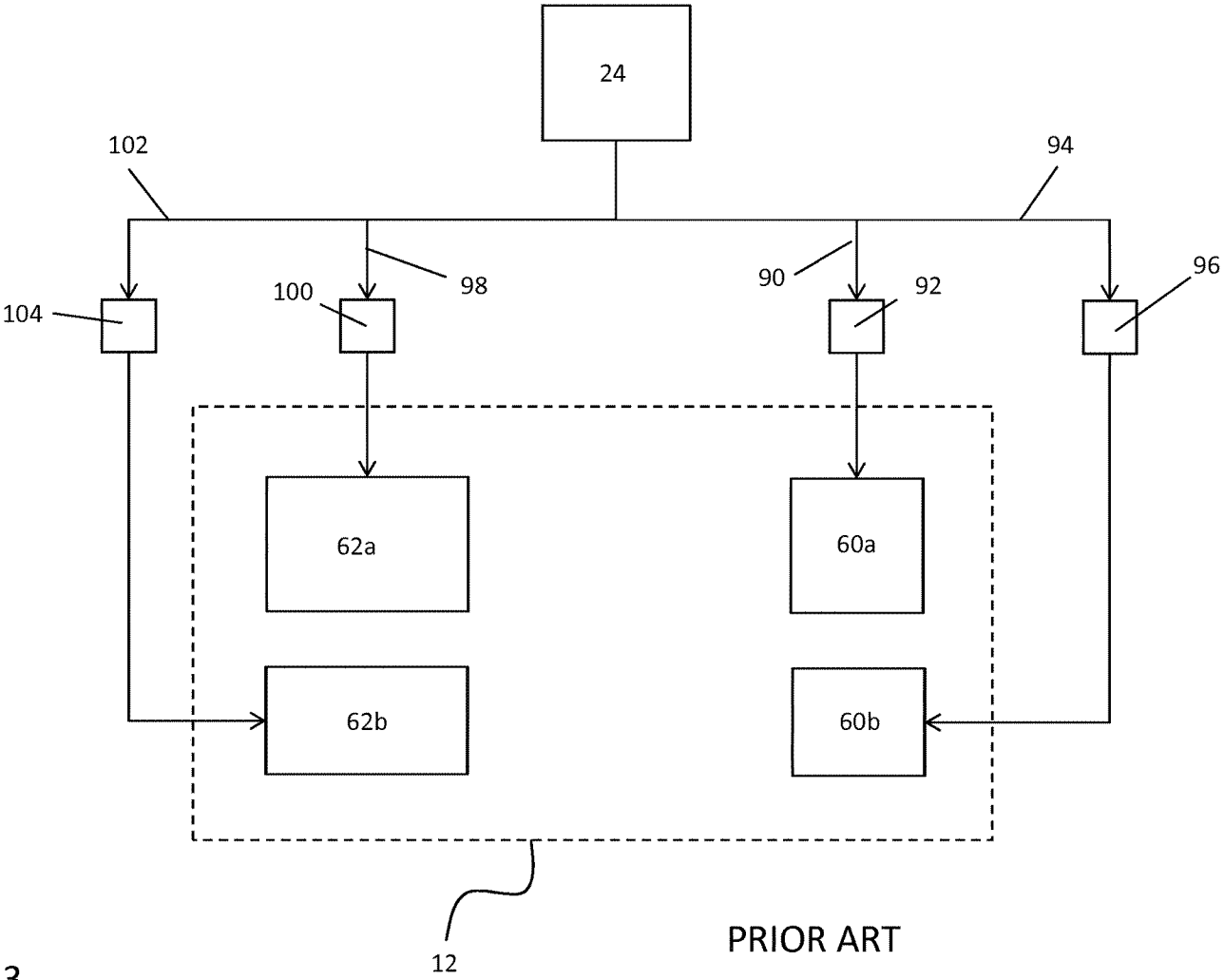
FIG. 3 is a schematic diagram of a known lubricant system configured to supply lubricant to a compressor.

A schematic diagram of a known lubrication system 20 for use with a compressor 12 is illustrated in FIG. 3. Conventional lubrication systems 20 include a plurality of conduits extending from the lubricant reservoir, each conduit being configured to supply lubricant to one of the bearings 60, 62 of the compressor 12. For example, a first conduit 90 including a first orifice 92 extends from the lubricant reservoir 24 to a first inlet bearing 60*a*, a second conduit 94 including a second orifice 96 extends from the lubricant reservoir 24 to the second inlet bearing 60*b*, a third conduit 98 including a third orifice 100 extends from the lubricant reservoir 24 to a first discharge bearing 62*a*, and a fourth conduit 102 including a fourth orifice 104 extends from the lubricant reservoir 24 to the second discharge bearing 62*b*. The size of each orifice 92, 96, 100, 104 may vary to control the flow rate and pressure drop of the lubricant being supplied to each of the bearings 60*a*, 60*b*, 62*a*, 62*b*.

Figure 4:
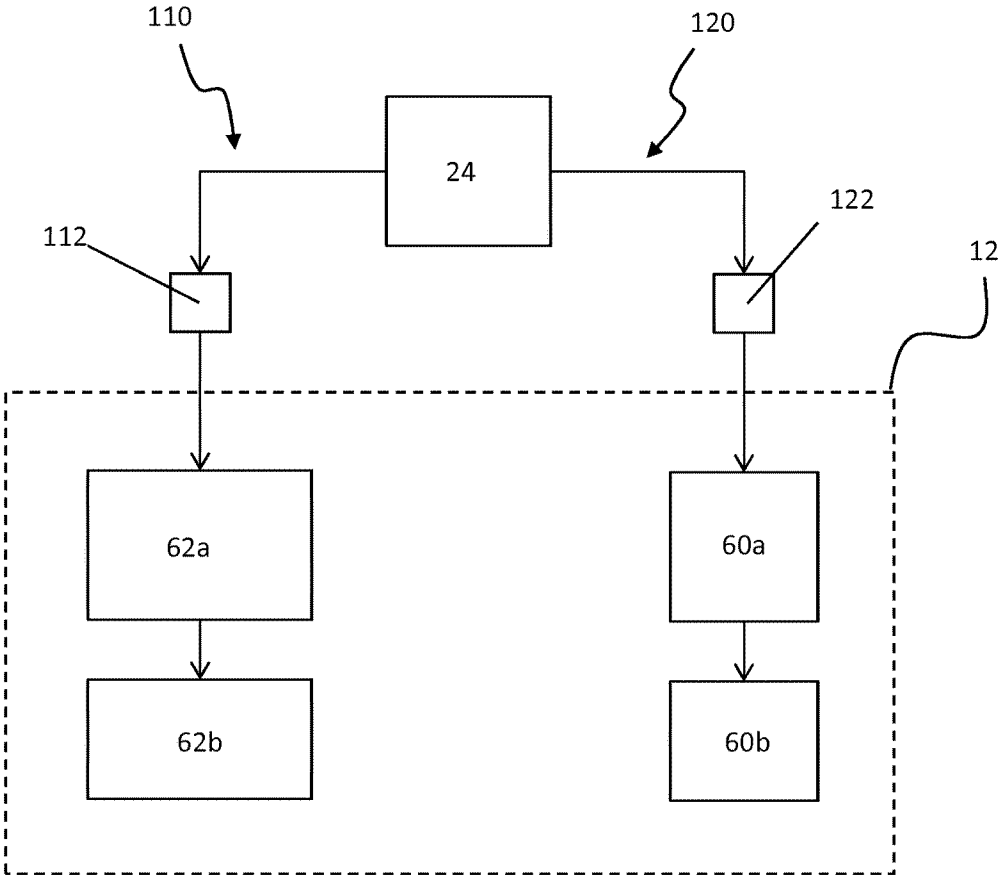
FIG. 4 is a schematic diagram of one or more lubricant flow paths configured to supply lubricant to the bearings of the compressor according to an embodiment of the invention.
Figure 5:
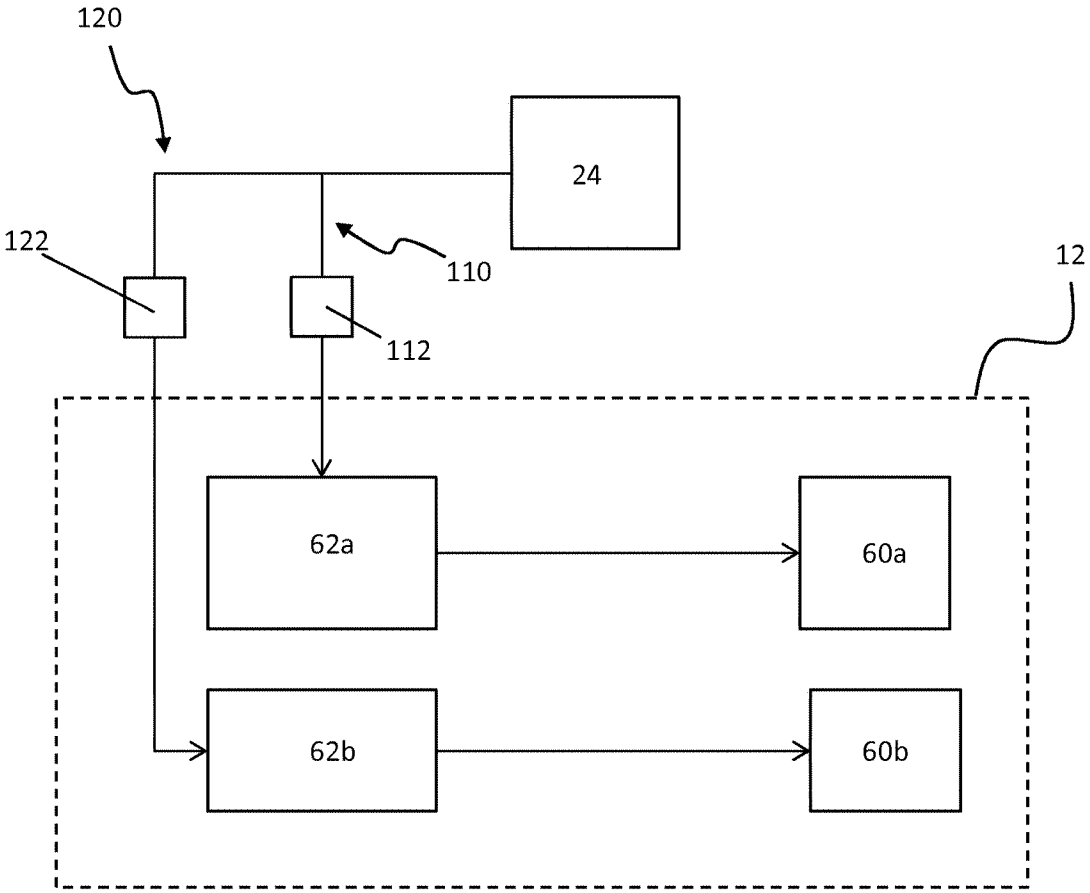
FIG. 5 is a schematic diagram of one or more lubricant flow paths configured to supply lubricant to the bearings of the compressor according to another embodiment of the invention.
Figure 6:
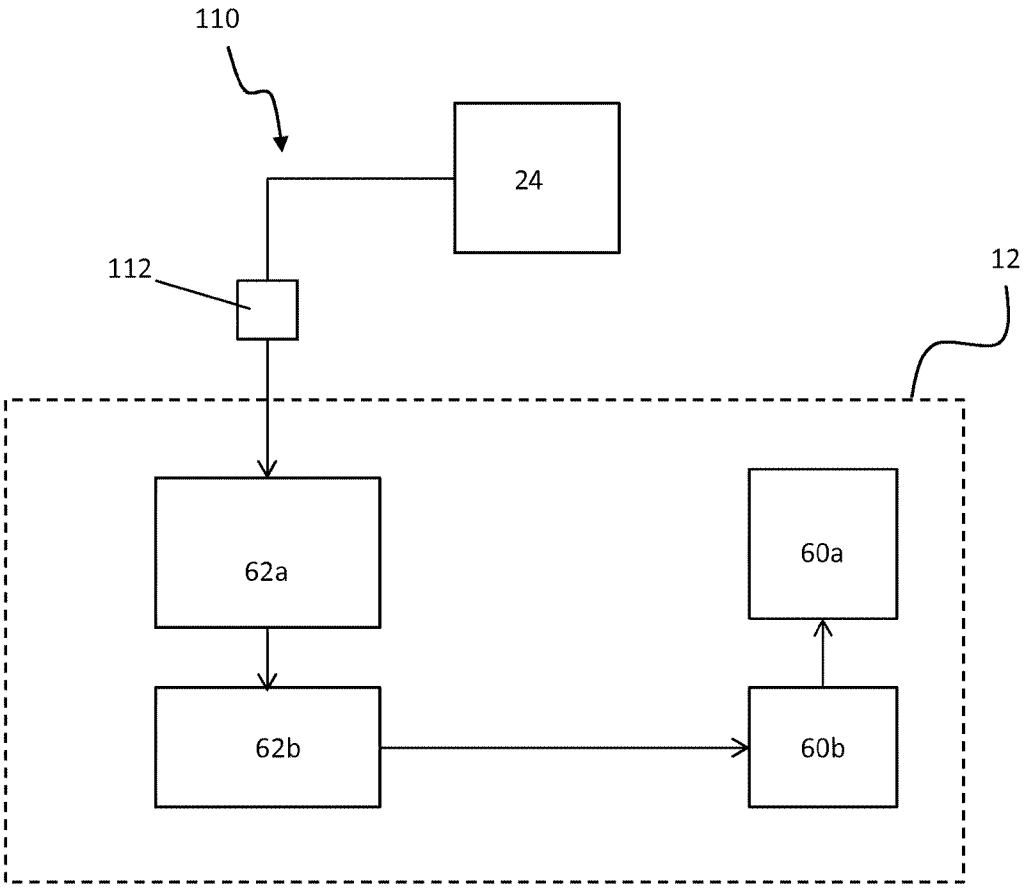
FIG. 6 is a schematic diagram of one or more lubricant flow paths configured to supply lubricant to the bearings of the compressor according to another embodiment of the invention.

Referring now to FIGS. 4-6, a lubrication system 20 according to various embodiments of the invention is illustrated. Lubricant from the lubricant reservoir 24 of the lubrication system 20 is supplied to a plurality of bearings 60*a*, 60*b*, 62*a* and 62*b* of the compressor 12 generally sequentially. As illustrated in FIG. 4, a first lubricant flow path 110 extends from the lubricant reservoir 24 to a first orifice 112 configured to provide a pressure drop and regulate the flow of lubricant within the first flow path 110. From the first orifice 112, the lubricant flows initially to the discharge bearing 62 of one of the rotors 36, 38, and then to the discharge bearing 62 of another of the rotors 36, 38. In the illustrated, non-limiting embodiment, lubricant from the first orifice 112 flows sequentially from the discharge bearing 62*a* of the male rotor 36 to the discharge bearing 62*b* of the female rotor 38 before being entrained in the refrigerant within the compressor 12. In embodiments where the compressor 12 includes more than two rotors 36, 38, the first lubricant flow path 110 may be configured to supply lubricant to a portion of, or alternatively, to all of the discharge bearings 62 in any order.

Similarly, a second lubricant flow path 120 extends from the lubricant reservoir 24 to a second orifice 122, similarly configured to provide a pressure drop and regulate the flow of lubricant within the second lubricant flow path 120. From the second orifice 122, the lubricant flows initially to the inlet bearing 60 of one of the rotors 36, 38, and then to the inlet bearing 60 of another of the rotors 36, 38. In the illustrated embodiment, the lubricant from the second orifice 122 is provided first to the inlet bearing 60*a* of the male rotor 36 and then to the inlet bearing 60*b* of the female rotor 38. In embodiments where the compressor 12 includes more than two rotors 36, 38, the second lubricant flow path 120 may be configured to provide lubricant to some or all of the inlet bearings 60 of the compressor 12 in any sequential order. The first and second lubricant flow paths 110, 120 may be formed directly in the housing assembly 32, may be formed using a plurality of conduits, or may be formed with some combination thereof.

In another embodiment, illustrated in FIG. 5, each lubricant flow path is configured to provide lubricant to the discharge bearing 62 and the inlet bearing 60 of a single rotor generally sequentially. For example, after passing through the first orifice 112, lubricant from the first lubricant flow path 110 is provided to first to the discharge bearing 62*a* of the male rotor 36 and, after passing through bearing 62*a*, flows to the inlet bearing 60*a* of the male rotor 36 before becoming entrained in the refrigerant of the compressor 12. Similarly, lubricant flowing through the second flow path 120, after passing through second orifice 122, is provided first to the discharge bearing 62*b* of the female rotor 38 and, after passing through bearing 62*b*, flows to the inlet bearing 60*b* of the female rotor 38. Although the lubricant flow paths 110, 120 are illustrated and described as providing lubricant first to the discharge bearing 62 and then to the inlet bearing 60 of a rotor 36, 38, other configurations, such as where lubricant flows through the inlet bearing 60 before being supplied to the discharge bearing 62 for example, are within the scope of the invention.

Referring now to FIG. 6, the lubrication system 20 may include a single flow path 110 extending from the reservoir 24 to the first orifice 112. The lubricant flow path 110 is configured to supply lubricant from the orifice 112 to each of the inlet bearings 60 and discharge bearings 62 of the compressor 12 sequentially. As illustrated, the lubricant is provided first to the discharge bearing 62*a* of the male rotor 36, then to the discharge bearing 62*b* of the female rotor 38. From there, lubricant is supplied to the inlet bearing 60*b* of the female rotor 38 and then to the inlet bearing 60*a* of the male rotor 36. As illustrated, the lubricant is initially provided to each of the discharge bearings 62 before being provided to each of the inlet bearings 60. However, other configurations, such as where the lubricant is provided to the plurality of inlet bearings 60 before the plurality of discharge bearings 62, or where the lubricant is provided to the inlet bearing 60 and the discharge bearing 62 of each rotor 36, 38 sequentially for example, are within the scope of the invention.

By providing the lubricant to a plurality of bearings 60, 62 of the compressor 12 sequentially, the temperature of the lubricant increases, causing the out-gassing of refrigerant from the lubricant, and therefore increasing the viscosity of the lubricant for bearings arranged generally downstream in the sequence. Cavitation of lubricant, induced by mechanical action of moving bearing parts on lubricant, may also cause out-gassing of refrigerant. The flow path of the lubricant may be selected so that the bearings having a higher viscosity requirement to prevent damage by metal-to-metal contact are positioned near an end of a lubricant flow path, and will receive lubricant having an increased viscosity. As a result, the compressor 12 may be operated at lower speed without incurring bearing damage.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compressor assembly, comprising:

a housing assembly;

a first rotor arranged within the housing assembly, the first rotor being supported for rotation by a first inlet bearing adjacent an inlet end of the housing assembly and by a first discharge bearing adjacent a discharge end of the housing assembly;

a second rotor arranged within the housing assembly, the second rotor being supported for rotation by a second inlet bearing adjacent the inlet end of the housing assembly and by a second discharge bearing adjacent the discharge end of the housing assembly; and a first lubricant flow path configured to supply lubricant from a lubricant reservoir to both the first discharge bearing and the first inlet bearing sequentially; and a second lubricant flow path configured to supply lubricant from the lubricant reservoir to at least one of the second discharge bearing and the second inlet bearing.

2. The compressor assembly according to claim 1, where each of the first discharge bearing, the first inlet bearing, the second discharge bearing and the second inlet bearing is arranged downstream from a pressure-reducing orifice.

3. The compressor assembly according to claim 1, wherein the lubricant supplied to the first lubricant flow path includes a mixture of lubricant and refrigerant, wherein a gaseous portion of the refrigerant in the mixture provided to the first inlet bearing is greater than the gaseous portion of the refrigerant in the mixture provided to the first discharge bearing.

4. The compressor assembly according to claim 3, wherein a viscosity of the lubricant provided to the first inlet bearing is greater than a viscosity of the lubricant provided to the first discharge bearing.

5. The compressor assembly according to claim 1, wherein the second lubricant flow path supplies lubricant to the second discharge bearing and the second inlet bearing sequentially.

6. The compressor assembly according to claim 5, wherein the lubricant supplied to the second lubricant flow path includes a mixture of lubricant and refrigerant, wherein a gaseous portion of the refrigerant in the mixture provided to the second inlet bearing is greater than the gaseous portion of the refrigerant in the mixture provided to the second discharge bearing.

7. The compressor assembly according to claim 6, wherein a viscosity of the lubricant provided to the second inlet bearing is greater than a viscosity of the lubricant provided to the second discharge bearing.

8. A compressor assembly, comprising:

a housing assembly;

a first rotor arranged within the housing assembly, the first rotor being supported for rotation by a first inlet bearing adjacent an inlet end of the housing assembly and by a first discharge bearing adjacent a discharge end of the housing assembly;

a second rotor arranged within the housing assembly, the second rotor being supported for rotation by a second inlet bearing adjacent the inlet end of the housing assembly and by a second discharge bearing adjacent the discharge end of the housing assembly; and a lubricant flow path configured to supply lubricant from a lubricant reservoir to each of the first discharge bearing, the first inlet bearing, the second discharge bearing and the second inlet bearing sequentially, wherein the lubricant flow path supplies lubricant to both the first discharge bearing and the second discharge bearing before supplying lubricant to either of the first inlet bearing and the second inlet bearing.

* * * * *